US006364634B1

(12) United States Patent
Svihla et al.

(10) Patent No.: US 6,364,634 B1
(45) Date of Patent: Apr. 2, 2002

(54) TURBOCHARGER ROTOR WITH ALIGNMENT COUPLINGS

(75) Inventors: Gary R. Svihla, Chicago; John R. Zagone, Westmont; James William Heilenbach, Riverside; Keith E. Moravec, Downers Grove, all of IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/676,581

(22) Filed: Sep. 29, 2000

(51) Int. Cl.[7] ..... F04B 35/00
(52) U.S. Cl. ..... 417/409
(58) Field of Search ..... 417/409, 407, 417/408

(56) References Cited

U.S. PATENT DOCUMENTS 4,560,325 A * 12/1985 Yoshioka et al. ..... 417/407
5,857,332 A * 1/1999 Johnston et al. ..... 60/607
6,032,466 A * 3/2000 Woollenweber et al. ..... 60/607
6,220,829 B1 * 4/2001 Thompson et al. ..... 417/407

* cited by examiner

*Primary Examiner*—Teresa Walberg
*Assistant Examiner*—Vinod D Patel
(74) *Attorney, Agent, or Firm*—Cary W. Brooks

(57) ABSTRACT

A turbocharger rotor includes a turbine wheel, a compressor wheel, a shaft extending between the turbine and compressor wheels for rotation together about an axis, and connecting means. The connecting means include first and second joints including alignment couplings joining opposite ends of the shaft with adjoining inner ends of the compressor wheel and the turbine wheel. The couplings are configured to coaxially align and drivingly engage the shaft with the compressor and turbine wheels. A fastener rod extends through the shaft and the compressor wheel, engaging the turbine wheel to retain the rotor components together under compressive load. The rod is resiliently stretchable to limit changes in the retaining force changes in axial dimensions during operating and stationary conditions. Additional features and variations are disclosed.

12 Claims, 5 Drawing Sheets

TURBOCHARGER ROTOR WITH ALIGNMENT COUPLINGS

TECHNICAL FIELD

This invention relates to engine exhaust driven turbochargers and more particularly to a turbocharger rotor having alignment couplings and a fastener rod joining compressor and turbine wheels with a connecting shaft.

BACKGROUND OF THE INVENTION

It is known in the art relating to exhaust driven engine turbochargers to provide a rotor including a turbine wheel and a compressor wheel connected by a shaft for rotation together about an axis. In some cases, the shaft is formed as an extension of the turbine wheel. Separate shaft and wheel components may be welded together before final machining. Alternatively, a steel shaft may be connected to the turbine and to the compressor wheel by separate connecting means. Commonly, the impeller or compressor wheel is made of aluminum alloy to minimize the rotating mass.

Various types of connecting means have been provided for aligning and connecting the wheels and the shaft for axial rotation. Where the connecting means extend through the compressor wheel and clamp the wheel in compression against the shaft, the design should avoid excessive variations in clamping load due to differential thermal growth and the effects of centrifugal force on the steel and aluminum during varying operating and stationary conditions. The means for connecting the compressor impeller wheel and the turbine wheel to the shaft are also important because the rotor must be disassembled after balancing in order to assemble the rotor into the turbocharger. Upon reassembly of the rotor, the repeat balance must preserve the original balance as far as possible without actually rebalancing the rotor in the turbocharger assembly. Connecting means that allow separation and reassembly of the components without changing the balance are therefore desired.

SUMMARY OF THE INVENTION

The present invention provides a rotor including a turbine wheel and a compressor wheel connected by a shaft for rotation together about an axis. Novel connecting means extend between the compressor and turbine wheels and limit the clamp load, or retaining force, variation applied to the compressor wheel under varying thermal expansion conditions experienced during operation and shutdown. The connecting means also provide for coaxially aligning or centering the compressor and turbine wheels on the axis of the connecting shaft with the capability of simple and repeatable reassembly.

The connecting means include a single long fastener rod, such as a stud or bolt, which extends through both the compressor wheel and the connecting shaft to engage the turbine wheel and place both the compressor wheel and the connecting shaft in compression. Preferably the fastener rod is threaded into the turbine wheel and carries a nut or head that clamps the compressor wheel and shaft in assembly with the turbine wheel. Optionally, the fastener rod could also extend through the turbine wheel and be secured to the turbine wheel by a nut or head.

The connecting means also include first and second joints between the shaft and the compressor wheel at one end and the turbine wheel at the other end. The joints are configured to maintain coaxial alignment of the compressor and turbine wheels with the shaft while providing high axial and bending stiffness and torque transmitting capability. Various forms of joints could be provided to meet these requirements. Examples include piloted shoulders and polygon connections as well as toothed couplings, among others. A presently preferred embodiment uses toothed couplings with so-called CURVIC™ coupling teeth.

Another preferred feature of the invention includes use of a steel adapter which is press fitted onto a stub of the aluminum alloy compressor wheel to provide a joint material similar to that of the connecting shaft. The adapter may also provide an oil sealing surface. A similar adapter may also be provided on the turbine wheel if desired.

The shaft may include one or more radial thrust surfaces preferably located inboard of associated bearing journals to limit oil sealing requirements. The thrust surfaces preferably face outward and are formed on flanges integral with the shaft.

These and other features and advantages of the invention will be more fully understood from the following description of certain specific embodiments of the invention taken together with the accompanying drawings.

DESCRIPTION OF THE PREFERRED EMBODIMENT

Figure 1:
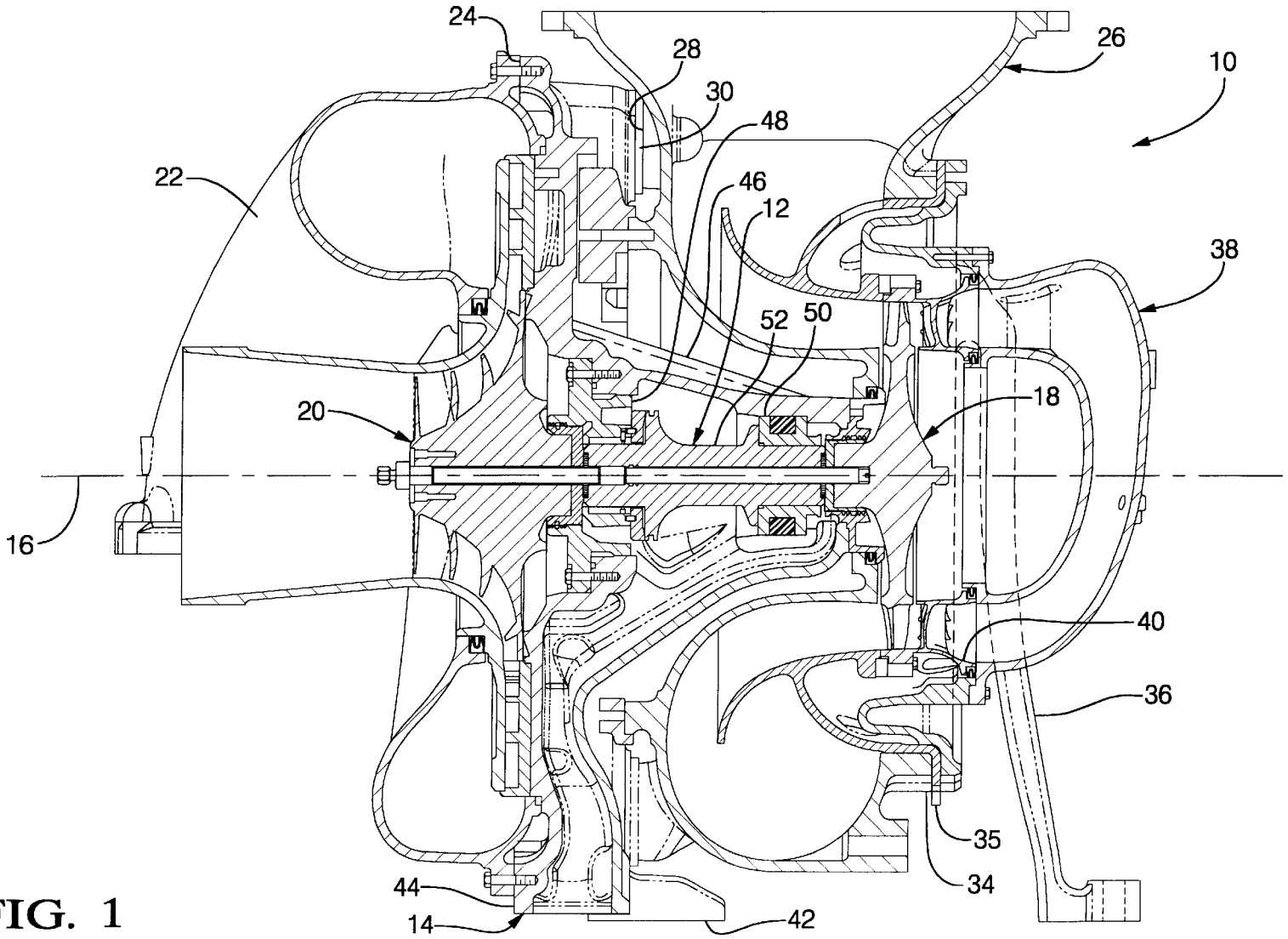
FIG. 1 is a cross-sectional view of an engine turbocharger having a rotor including features in accordance with the invention.

Referring now to the drawings in detail, numeral 10 generally indicates an exhaust driven turbocharger for an engine, such as a diesel engine intended for use in railway locomotives or other applications of medium speed diesel engines. Turbocharger 10 includes a rotor 12 carried by a rotor support 14 for rotation on a longitudinal axis 16 and including a turbine wheel 18 and a compressor wheel 20. The compressor wheel is enclosed by a compressor housing assembly 22 including components which are supported on an axially facing first side 24 of the rotor support 14. An exhaust duct 26 has a compressor end 28 that is mounted on a second side 30 of the rotor support 14 spaced axially from the first side 24.

The exhaust duct 26 is physically positioned between the rotor support 14 and the turbine wheel 18 to receive exhaust gases passing through the turbine wheel and carry them to an exhaust outlet 32. A turbine end 34 of the exhaust duct 26 and an associated nozzle retainer assembly 35 are separately supported by an exhaust duct support 36 that is connected with the exhaust duct 26 at the turbine end 34. The exhaust duct support 36 also supports a turbine inlet scroll 38 which receives exhaust gas from the associated engine and directs it through a nozzle ring 40 to the turbine wheel 18 for transferring energy to drive the turbocharger compressor wheel 20.

The rotor support 14 includes a pair of laterally spaced mounting feet 42 which are rigidly connected to an upstanding mounting portion 44 of the rotor support 14 and are adapted to be mounted on a rigid base, not shown. The rotor support 14 further includes a tapering rotor support portion 46 having bearings 48, 50 that rotatably support the rotor 12. Bearing 48 is a combination sleeve and thrust bearing while bearing 50 is primarily a sleeve bearing.

Figure 2:
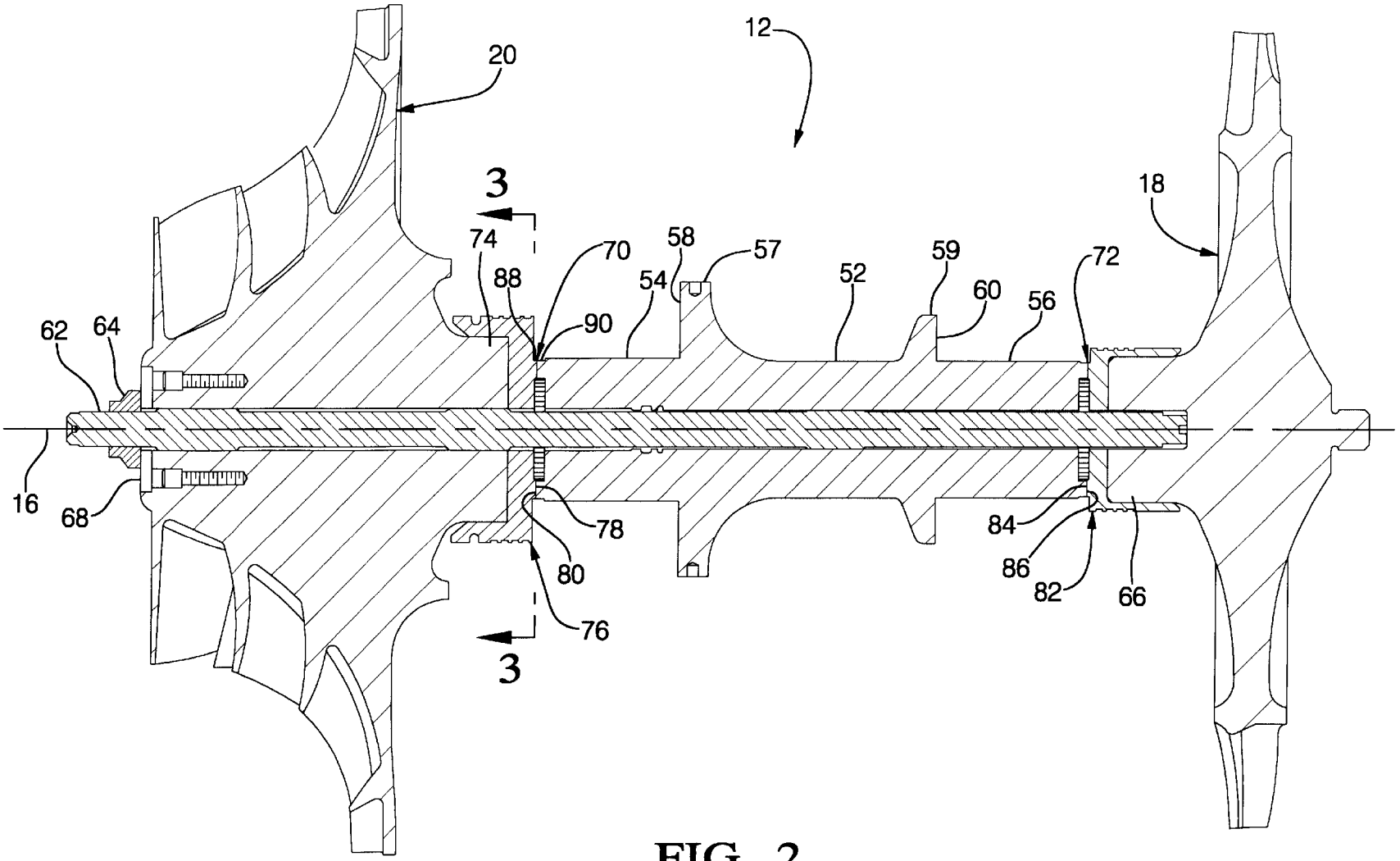
FIG. 2 is a side view partially in cross section of the rotor in the embodiment of FIG. 1.

Referring particularly to FIG. 2, the rotor 12 includes a shaft 52 connected with the turbine wheel 18 at one end and the compressor wheel 20 at the opposite end. The shaft 52 includes a pair of axially spaced bearing supported portions or journals 54, 56, respectively adjacent the compressor and turbine wheel ends of the shaft. A flange 57, inboard of journal 54, carries a radial thrust reaction surface 58. A second flange 59, inboard of journal 56, carries a radial anti-thrust reaction surface 60. Journals 54, 56 are respectively supported in bearings 48, 50 (FIG. 1). Radial surface 58 carries thrust forces to the sleeve/thrust bearing 48 and radial surface 60 limits axial movement of the rotor 12.

A particular advantage of the invention is gained by having the thrust reaction surface 58 and the anti-thrust reaction surface 60 both face outward toward the ends of the shaft 52. This is made possible by separating the shaft from the compressor and turbine wheels and allows both flanges 57, 59 to be made integral with the shaft, which avoids separate thrust flanges and simplifies machining of the shaft itself. The separation also benefits design modification and rebuild functions because modification or replacement of the turbine or compressor portions need not affect the bearings or the shaft portion.

In accordance with the invention, the rotor elements including the compressor wheel 20, shaft 52 and turbine wheel 18 are retained in assembly by connecting means including a fastener rod, preferably comprising a stud 62 and nut 64. The stud 62 extends through axial openings in the compressor wheel 20 and the shaft 52 and is threaded into a threaded recess in an inner end 66 of the turbine wheel 18. The nut 64 is threaded onto an opposite end of the stud and engages a washer 68 on an outer end of the compressor wheel. The nut 64 is tightened a predetermined amount to place under compressive load additional elements of the connecting means, including connections or first and second joints 70, 72 between the shaft 52 and the compressor wheel 20 and turbine wheel 18 respectively.

The stud 62 is sized to resiliently stretch a desired amount as the nut is tightened to compress the rotor elements. In this way, variations in the compressive force on the rotor elements due to axial dimensional changes in the rotor components, in operation or while stationary, are limited by stretching of the stud 62 so that excessive variations in compressive load are not encountered. This is particularly desirable, since the compressor wheel is made of aluminum alloy, which has a greater thermal coefficient of expansion than the stud 62 and other elements of the rotor made of steel. If desired, another suitable form of fastener rod, such as a long bolt with a head, could be used in place of the stud 62 and nut 64, as long as the force limiting feature of the fastener rod is retained. Use of a fastener rod to load and connect the rotor elements axially requires only a relatively small axial opening through the compressor wheel and a small threaded recess in the turbine wheel. Thus, stresses in the wheels are reduced as compared to other connecting methods and increased maximum rotor speeds are permitted.

In accordance with the invention, the first and second joints 70, 72 of the connecting means are provided for aligning and connecting the compressor and turbine wheels on their respective ends of the shaft 52. The joints 70, 72 must maintain coaxial alignment of the compressor and turbine wheels with the shaft while providing high axial stiffness under compression, high bending stiffness, and torque transmitting capability. Many joint configurations exist that could meet the above requirements and are intended to be included within the broad scope of the invention. Accuracy, reliability and cost are also factors to be considered in selecting a suitable joint configuration.

Presently preferred embodiments of joints 70, 72 are illustrated in FIGS. 2–5. The compressor wheel 20 includes on an inner end a stub 74 carrying a pressed-on steel adapter 76 having a ring shaped end face 78 of the compressor wheel that engages a compressor end 80 of the shaft 52 at the first joint 70. Adapter 76 also includes a generally cylindrical seal surface 81, for cooperating with a compressor oil seal of the turbocharger to control oil leakage toward the compressor wheel 20. The turbine wheel 18 similarly includes on its inner end 66 a steel adapter 82 having a ring shaped end face 84 that engages a turbine end 86 of the shaft 52 at the second joint 72. Adapter 82 also includes a generally cylindrical seal surface 87 for cooperating with a turbine oil seal to control oil leakage toward the turbine. The inboard location of the thrust flanges and their reaction surfaces 58, 60 of shaft 52 also helps control oil seal leakage, because oil flowing from the thrust flanges is directed away form the oil seal surfaces 81, 87.

Figure 3:
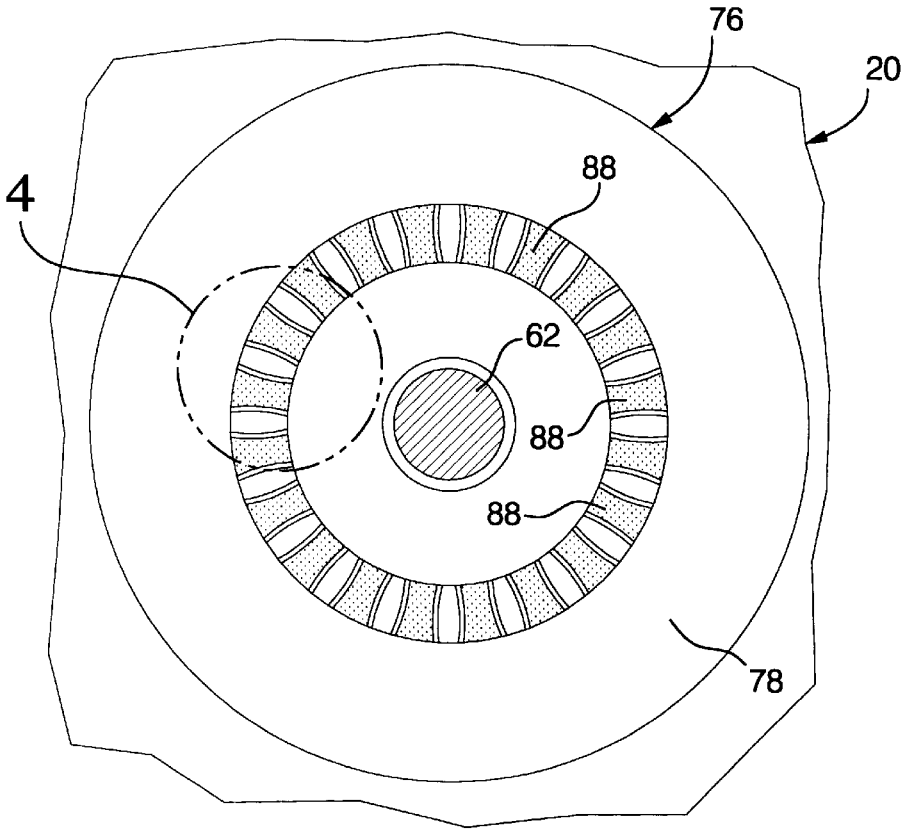
FIG. 3 is an end view from the plane of the line 3—3 of FIG. 2 showing a toothed coupling portion of the compressor wheel.
Figure 4:
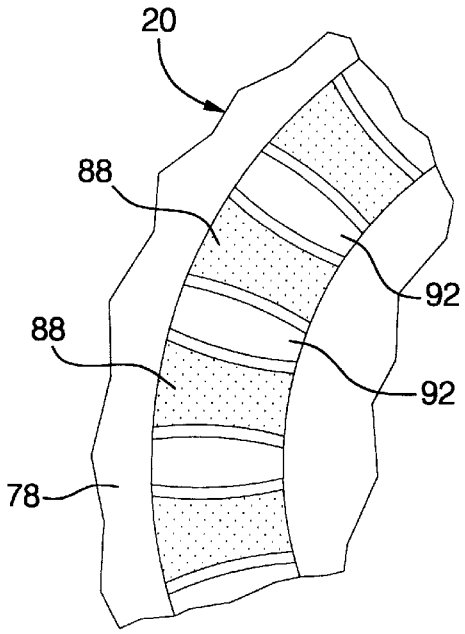
FIG. 4 is an enlarged end view of the compressor wheel coupling teeth shown in the circle 4 of FIG. 3.
Figure 5:
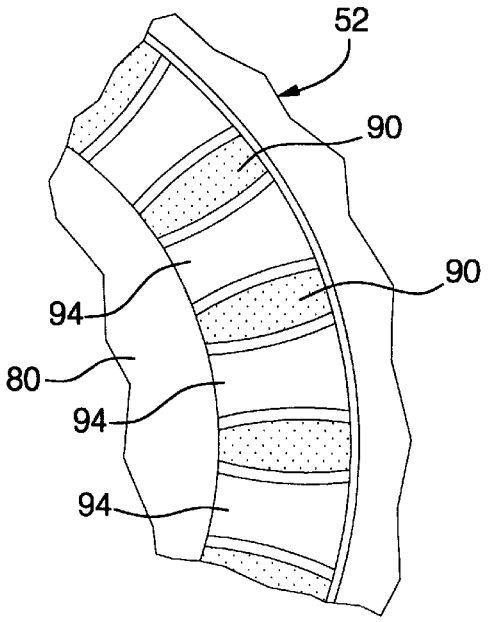
FIG. 5 is an enlarged end view of the rotor shaft coupling teeth configured for mating with the compressor wheel coupling teeth.

FIGS. 3–5 show details of the first joint, which are similar to those of the second joint. The end face 78 of the compressor wheel 20 mounts an axially centered first ring of coupling teeth 88 extending axially inward from the end face 78 toward the compressor end 80 of the shaft 52. The shaft 52 similarly has on the compressor end 80 a second ring of mating coupling teeth 90 extending axially outward into engagement with coupling teeth 88 of the first ring. Preferably, the coupling teeth take the form of a so-called CURVIC™ coupling in which the first ring of teeth 88 of the compressor wheel are formed with concave sides separated by convexly sided spaces 92 and the mating teeth 90 on the shaft have convex sides separated by concavely curved spaces 94. These configurations are best shown in FIGS. 4 and 5.

The second joint 72 similarly includes an axially centered third ring of coupling teeth 88 extending axially inward from the end face 84 of the turbine toward the turbine end 86 of the shaft 52. The shaft similarly has on the turbine end 86 a fourth ring of mating coupling teeth 90 extending axially outward into engagement with coupling teeth 88 of the third ring. These teeth also preferably take the form of a CURVIC™ coupling as described above. The toothed couplings at the first and second joints meet the requirements of the joints by maintaining coaxial alignment of the compressor and turbine wheels with the shaft while providing high axial stiffness when under compression with high bending stiffness, and torque transmitting capability.

The rotor 12 is first assembled outside the turbocharger as shown in FIG. 2. It is balanced, marked to show the locations of the mating coupling teeth and subsequently disassembled for reassembly with other components in the buildup of a complete turbocharger. Upon reassembly within the turbocharger, the rotor components are axially aligned by the toothed couplings and angularly positioned with the same phase angles maintained during balancing by aligning the marked teeth of the couplings. The reassembled rotor is thus maintained in essentially the same balance condition as originally provided by the original balance operation outside of the turbocharger.

Figure 6:
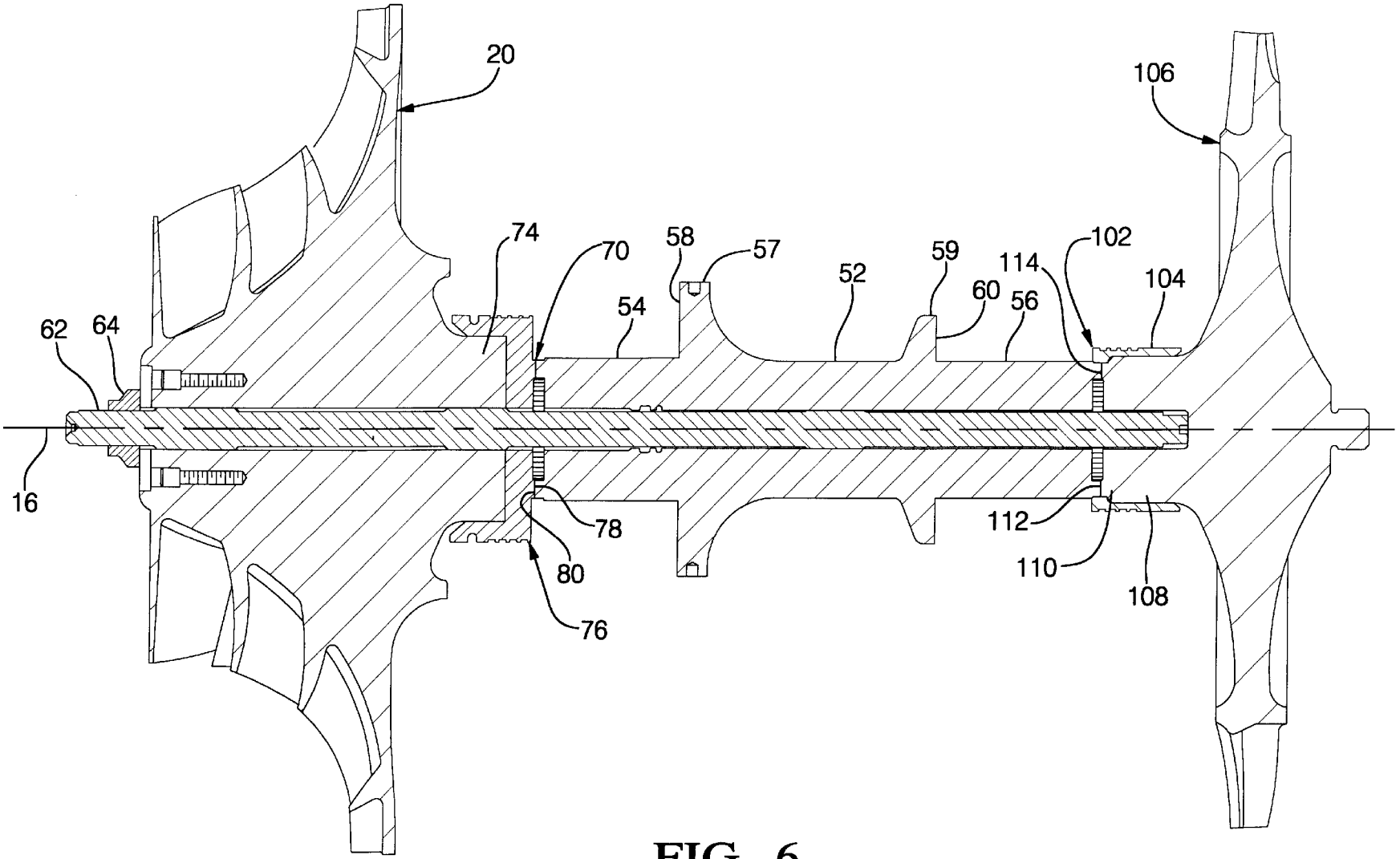
FIG. 6 is a view similar to FIG. 2 but showing a modified embodiment of the invention.

Referring now to FIG. 6 of the drawings wherein like numerals indicate like parts or features, numeral 100 indicates a turbocharger rotor similar to that of FIG. 2. Rotor 100 differs from rotor 12 in that the turbine adapter is replaced by a seal collar 102, which forms a cylindrical seal surface 104 but does not form an inner face of the turbine wheel 106. Instead, a stub 108 of the wheel 106 has an inner end 110 integral with a ring shaped inner face 112 and a third ring of coupling teeth 114 integrally formed on the inner face 112. Teeth 114 may be configured like teeth 88 on the turbine wheel adapter 82 of the embodiment of FIG. 2, and so the turbine wheel 106 may be made interchangeable with turbine wheel 18 illustrated in FIGS. 1 and 2. The coupling teeth may be formed on the turbine wheel because the turbine wheel material has a hardness similar to the shaft 52 to which it is coupled. The aluminum material of the compressor wheel makes use of the adapter 76 necessary, or at least desirable, to avoid having aluminum teeth on the compressor wheel 20 engaging steel teeth on the shaft 52.

Figure 7:
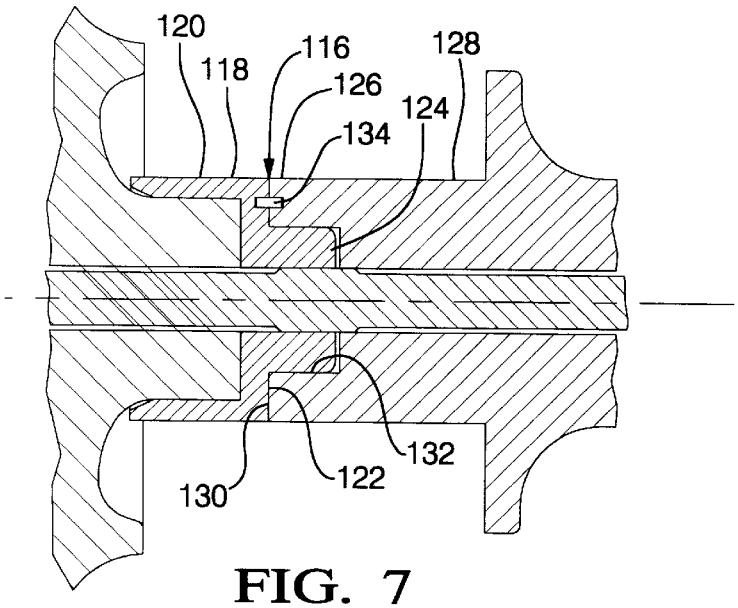
FIG. 7 is a fragmentary cross-sectional view showing an alternative rotor having an exemplary piloted shoulder coupling.
Figure 8:
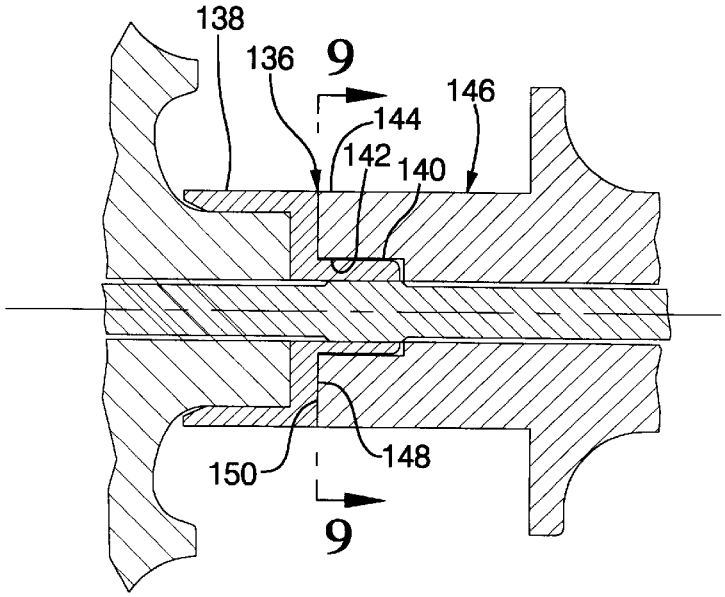
FIG. 8 is a view similar to FIG. 7 but showing a polygon coupling.
Figure 9:
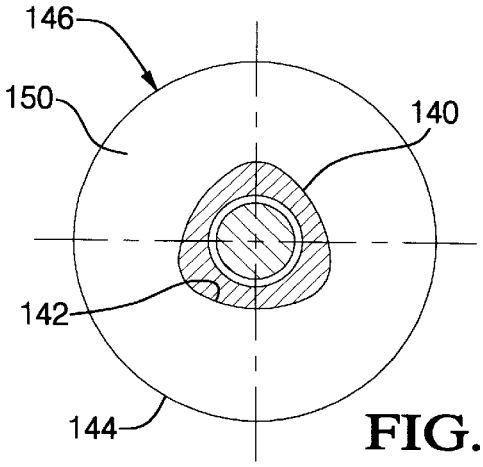
FIG. 9 is an end view from line 9—9 of FIG. 8 showing the shape of the polygon recess in the shaft coupling.

FIGS. 7–9 illustrate two examples of alternative joint configurations that could be selected for use in a turbocharger rotor of according to the invention. These examples are not meant to limit the scope of the invention, but only to show some considered alternatives.

FIG. 7 illustrates one form of piloted shoulder coupling joint 116 located at the inner end of compressor wheel 20 but also usable at the joint between the shaft and turbine wheel, not shown. Joint 116 includes a male coupling 118 formed on an adapter 120 fixed on the inner end of the compressor wheel 20. Coupling 118 includes an annular shoulder 122 surrounding a protruding cylindrical pilot 124 formed with a circular cross section. A mating female coupling 126 is formed in an end of the connecting shaft 128 and includes an annular abutment 130 engaging the shoulder 122. A cylindrical recess 132 is axially centered on the shaft end and receives the pilot 124 of coupling 118 with a close fit. The pilot 124 and surrounding shoulder 122 and the mating recess 132 and abutment 130 of the couplings assure coaxial alignment of the compressor wheel 20 with the shaft 128 when the components are compressed by the stud 62 and nut 64 comprising the fastener rod. A similar coupling joint, not shown, may be applied at the turbine end of the shaft 128. Preferably, a dowel 134 connects the adapter 120 with the shaft 128 to maintain angular positioning of the components upon reassembly of the rotor.

FIGS. 8 and 9 illustrate one form of so-called polygon coupling joint 136. The polygon joint is similar to the piloted shoulder joint 116 just described and may be used in the same locations. The adapter located polygon coupling 138 differs in that the protruding pilot 140 and the mating recess 142 of the shaft coupling 144 of shaft 146 have polygon shaped cross sections as shown, for example, by recess 142 in FIG. 9. The shoulder 148 of the male coupling 138 and the mating abutment 150 of the shaft coupling 144 differ in configuration but have the same purpose as the similar features 122, 130 of joint 116. With the polygon joint 136, a locating dowel is not needed, since marking the assembled rotor components allows reassembly in the same location determined by the polygon pilot. In other ways, coupling joints 136 and 116 may be essentially the same.

While the invention has been described by reference to certain preferred embodiments, it should be understood that numerous changes could be made within the spirit and scope of the inventive concepts described. Accordingly, it is intended that the invention not be limited to the disclosed embodiments, but that it have the fall scope permitted by the language of the following claims.

What is claimed is:

1. A rotor for an engine turbocharger, the rotor including a turbine wheel, a compressor wheel, a separate shaft connected at opposite ends with the turbine and compressor wheels for rotation together about a common axis, and connecting means comprising:

first and second joints each including alignment couplings joining opposite ends of the shaft with adjoining inner ends of the compressor wheel and the turbine wheel respectively, said couplings being configured to coaxially align and drivingly engage the shaft with the compressor and turbine wheels, and a fastener rod extending axially through at least the shaft and the compressor wheel and engaging the turbine wheel to retain the shaft and the wheels together with a compressive force, said rod being resiliently stretchable to limit changes in retaining force on the wheels and shaft due to axial dimensional changes in the rotor components during operating and stationary conditions.

2. A rotor as in claim 1 wherein said shaft includes axially spaced bearing journals for supporting the rotor, and thrust flanges inboard of the bearing journals.

3. A rotor as in claim 2 wherein the thrust flanges are integral with the shaft and include axially outwardly facing thrust faces.

4. A rotor as in claim 1 wherein said compressor includes a stub mounting a first adapter, the adapter defining one of the alignment couplings of said first joint.

5. A rotor as in claim 4 wherein said first adapter includes a lubricant sealing surface.

6. A rotor as in claim 1 wherein said turbine includes a stub mounting a second adapter defining one of the alignment couplings of said second joint.

7. A rotor as in claim 6 wherein said first and second adapters each include a lubricant sealing surface.

8. A rotor as in claim 5 wherein the turbine wheel includes a stub mounting a seal collar including a lubricant sealing surface.

9. A rotor as in claim 1 wherein the alignment couplings of said first joint include first and second rings of mating coupling teeth, said first ring of teeth formed on an end face of the compressor wheel and said second ring of teeth formed on a first end of said shaft.

10. A rotor as in claim 1 wherein the alignment couplings of said second joint include third and fourth rings of mating coupling teeth, said third ring of teeth formed on an end face of the turbine wheel and said fourth ring of teeth formed on a second end of said shaft.

11. A rotor as in claim 1 wherein said alignment coupling of at least one of said joints define a piloted shoulder coupling joint.

12. A rotor as in claim 1 wherein said alignment couplings of at least one of said joints define a driving polygon coupling joint.

* * * * *